US007467535B2

(12) United States Patent
Kuno et al.

(10) Patent No.: US 7,467,535 B2
(45) Date of Patent: Dec. 23, 2008

(54) STAMPING MACHINE

(75) Inventors: Tsutomu Kuno, Shizuoka-ken (JP); Yoshihiro Shikano, Aichi Prefecture (JP)

(73) Assignee: Roland DG Corporation, Hamamatsu-shi (JP)

( * ) Notice: Subject to any disclaimer, the term of this patent is extended or adjusted under 35 U.S.C. 154(b) by 434 days.

(21) Appl. No.: 11/317,224

(22) Filed: Dec. 22, 2005

(65) Prior Publication Data

US 2007/0000299 A1 Jan. 4, 2007

(30) Foreign Application Priority Data

Jul. 4, 2005 (JP) ..... 2005-195445

(51) Int. Cl.
*B21J 11/00* (2006.01)
*B21D 5/06* (2006.01)

(52) U.S. Cl. ..... 72/446; 72/455; 72/430; 72/707; 72/379.2; 72/462; 72/447; 72/404

(58) Field of Classification Search ..... 72/324, 72/464, 454, 455, 430, 707, 453.02, 453.03, 72/3, 14.8, 43, 75, 125, 297, 379.2, 462, 72/307, 447
See application file for complete search history.

(56) References Cited

U.S. PATENT DOCUMENTS 5,896,643 A * 4/1999 Tanaka ..... 72/462
6,003,358 A * 12/1999 Lipari et al. ..... 72/447
6,151,942 A * 11/2000 Itaya ..... 72/137
6,216,508 B1 * 4/2001 Matsubara et al. ..... 72/379.2
6,460,387 B1 * 10/2002 Seto ..... 72/3
6,792,788 B2 * 9/2004 Futamura et al. ..... 72/453.03
6,892,616 B2 * 5/2005 Yasoda et al. ..... 72/324
7,010,953 B2 * 3/2006 Stupecky ..... 72/416

* cited by examiner

*Primary Examiner*—David B Jones
(74) *Attorney, Agent, or Firm*—Lee, Hong, Degerman, Kang & Waimey

(57) ABSTRACT

The present invention is related to a stamping machine for stamping an item at a high speed. The stamping machine comprises a case having an opening, at least one guide shaft formed in an interior of the case and extending in a first direction, a pedestal movable along the at least one guide shaft in the first direction for holding the worked item, and a stamping part for pressing the working tool against the worked item held on the pedestal. The stamping part comprises at least one guide shaft formed in an interior of the stamping part and extending in a second direction, a head driver formed in the interior of the stamping part and extending in the second direction, and a stamping head movable along the at least one guide shaft and the head driver in the second direction, wherein the stamping head is proximal to the pedestal.

24 Claims, 4 Drawing Sheets

FIG. 2A
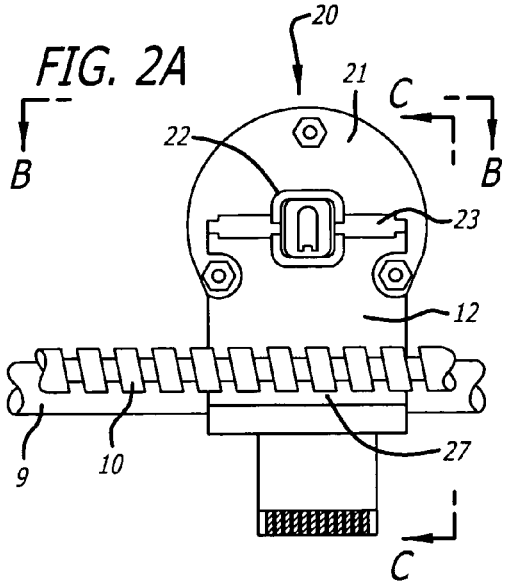
FIG. 2B
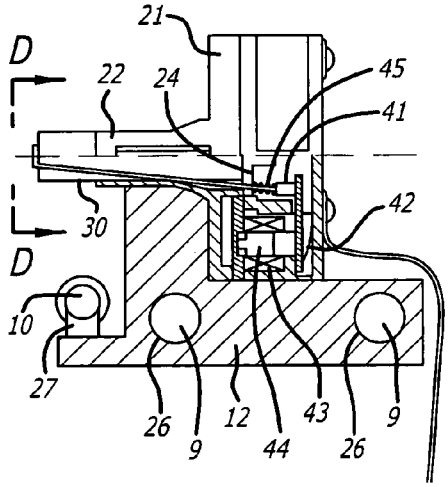
FIG. 2C
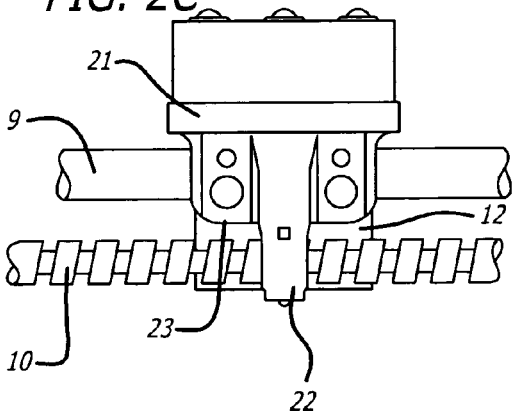
FIG. 2D
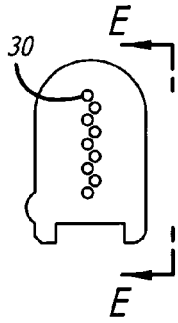
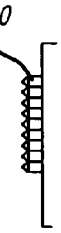
FIG. 2E
FIG. 2F
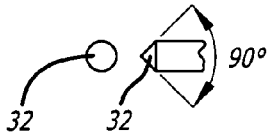
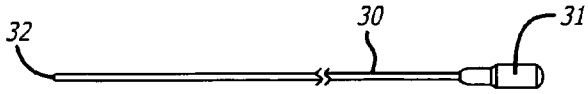
FIG. 2G FIG. 3
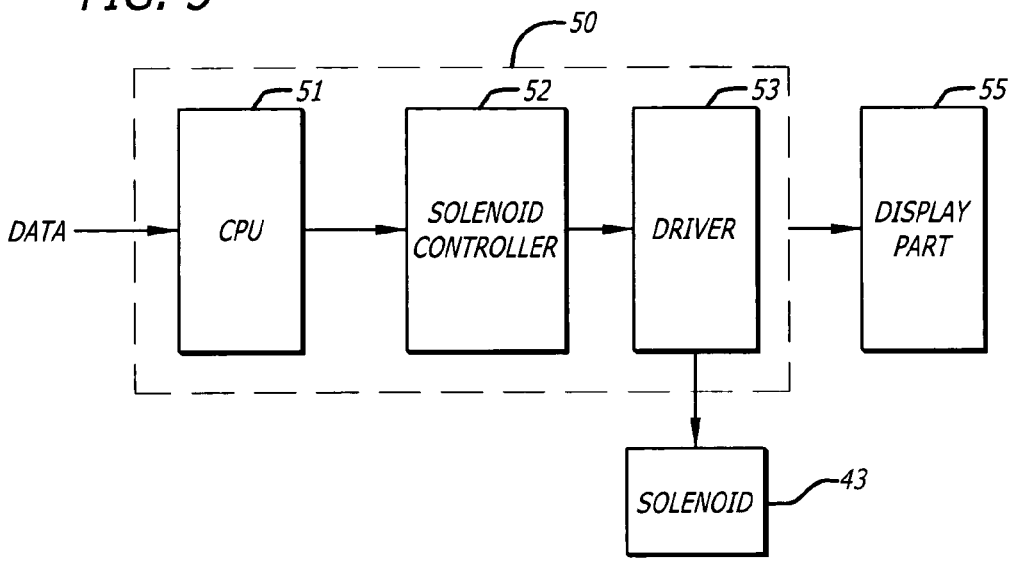
FIG. 4
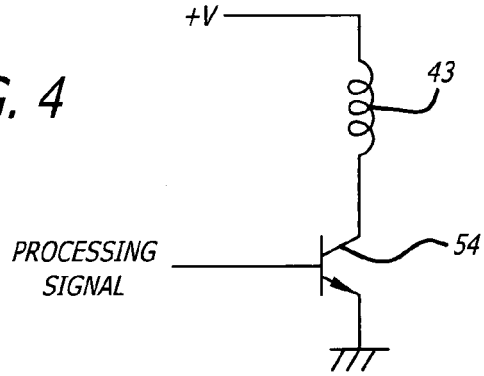
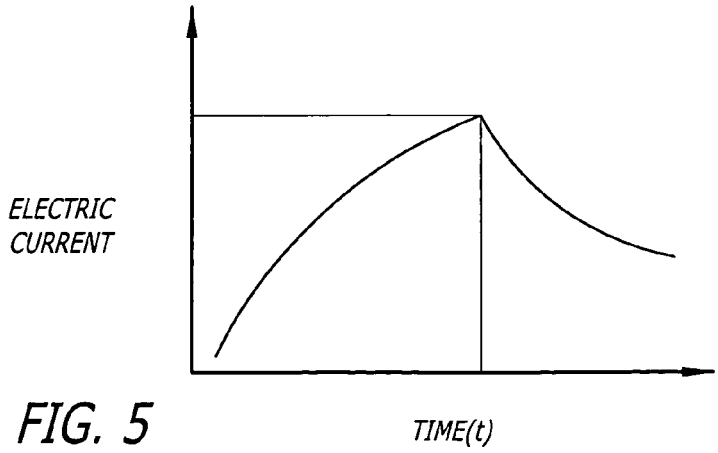
FIG. 5

FIG. 6
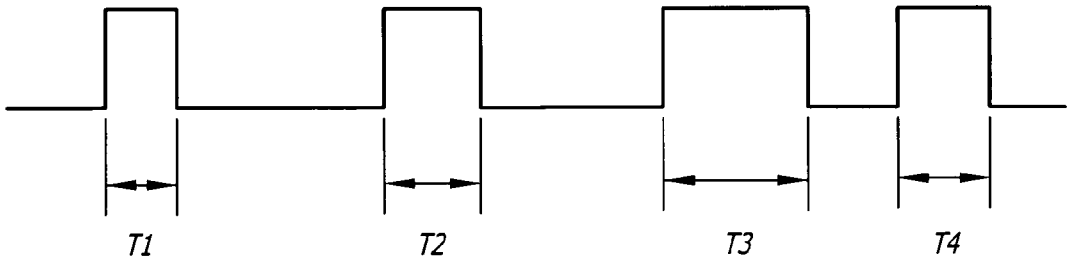
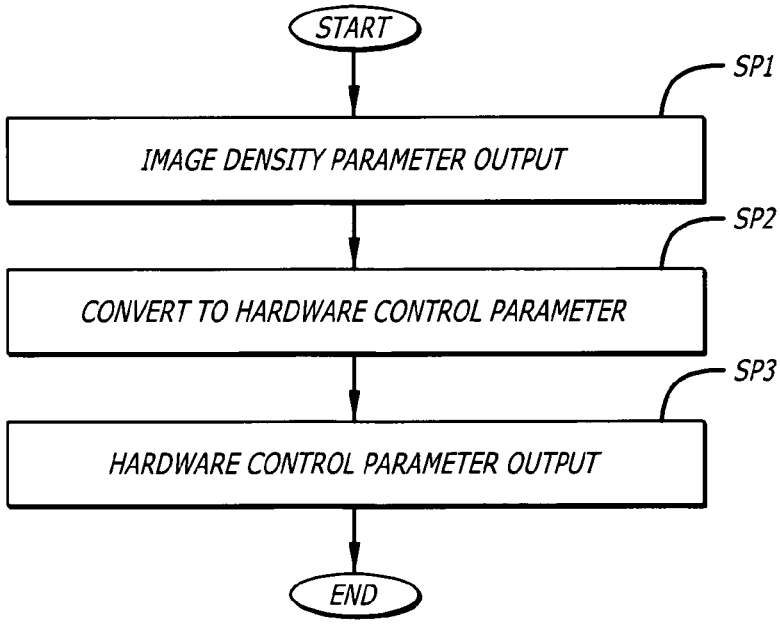
FIG. 7

STAMPING MACHINE

CROSS-REFERENCE TO RELATED APPLICATIONS

Pursuant to 35 U.S.C. § 119(a), this application claims the benefit of earlier filing date and right of priority to Japanese Application No. 2005-195445, filed on Jul. 4, 2005, the contents of which is hereby incorporated by reference herein in its entirety.

FIELD OF THE INVENTION

The present invention relates to a stamping machine and, particularly, to a stamping machine for pressing a working tool on a surface of an item and capable of forming an image on the item at a high speed.

BACKGROUND OF THE INVENTION

A stamping machine is an apparatus for performing work on items such as accessories and jewelry. A prior art stamping machine is provided with a plunger so as to pass through a solenoid, and a working tool on a lower part of the plunger. One example of a working tool may be one with a diamond tip, the front end of which has been worked to 90 degrees and attached to a tip of a needle with a diameter of 2 mm. By passing electric current to the solenoid, the plunger is attracted causing the working tool to descend. The working tool descends such that it contacts a surface of an item placed and held on an upper surface of a pedestal. Voltage applied to the solenoid may be changed to vary the strength of the pressing force of the plunger when the working tool contacts the item. Accordingly, a desired impression may be imparted to the item by varying the voltage. However, other examples of stamping machines exist that stamp an item at a uniform force.

The prior art stamping machine can process at a maximum stamping speed of 100 Hz. However, because of problems due to needle weight and stamping mechanism weight, it is impossible to raise the stamping speed above 100 Hz. Proposed solutions for raising the stamping speed, such as reducing the size and lightening the weight of the needle have been considered. However, these solutions are not desirable because attaching a diamond tip to the needle becomes impossible if the needle's size is greatly reduced.

Accordingly, the present invention provides for a stamping machine that stamps at a high speed.

SUMMARY OF THE INVENTION

The present invention is directed to a stamping machine for pressing a working tool on a surface of an item and capable of forming an image on the item at a high speed.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in a stamping machine for pressing a working tool against a surface of a worked item, the stamping machine comprising at least one guide shaft extending in a first direction, a pedestal movable along the at least one guide shaft in the first direction for holding the worked item, and a stamping part for pressing the working tool against the worked item held on the pedestal The stamping part comprises at least one guide shaft extending in a second direction, a head driver extending in the second direction, and a stamping head movable along the at least one guide shaft and the head driver in the second direction, wherein the stamping head is proximal to the pedestal for holding the worked item.

The at least one guide shaft formed extending in the first direction is a pair of guide shafts formed parallel to each other and separated by a prescribed distance. The worked item is fixed to the pedestal by an adhesive.

The at least one guide shaft extending in the second direction is a pair of guide shafts formed parallel to each other and separated by a prescribed distance.

The stamping machine further comprises a first motor for moving the pedestal along the at least one guide shaft in the first direction and a second motor for moving the stamping head along the at least one guide shaft in the second direction.

The head driver comprises a groove formed in a spiral shape and is rotated by the second motor. A joining piece is connected with the groove of the head driver for operatively coupling the head driver to the stamping head via a slide member, wherein the slide member is formed on and slidable along the at least one guide shaft in the second direction.

The stamping head is attached to the slide member by an attachment tool. The stamping part further comprises a rotating dial for rotating the stamping part. Preferably, the stamping head stamps at a maximum speed of 1000 Hz.

In one aspect of the invention, the stamping head comprises a cylindrical-shaped head frame, a front end housing extending from the head frame, and an attachment tool for attaching the stamping head to the slide member.

The stamping machine further comprises a head wire housed within the front end housing and the cylindrical-shaped head frame for stamping the worked item, wherein an outer end of the head wire has a conical shape. Preferably, the conical shape has an angle of 90 degrees.

Preferably, the head wire is a wire member comprising a plurality of wires. The plurality of wires protrude out of the front end housing toward the pedestal for stamping the worked item. The plurality of wires are arranged in a staggered formation and straddling a central line. The plurality of wires may be used simultaneously or sequentially.

The head wire is controllably driven by a driving means housed within the stamping head. The driving means controllably drives the head wire in response to data. The driving means is at least one of a solenoid and a permanent magnet.

A stamping strength of the head wire is controllable. Preferably, the stamping machine comprises a computer for controlling the stamping machine. Preferably, the at least one guide shaft is supported by the case.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

FIGS. 2(A)-2(G) illustrate a stamping head in accordance with one embodiment of the present invention.

FIG. 3 is a schematic block diagram of a control circuit for controlling a stamping machine in accordance with one embodiment of the present invention.

FIG. 4 is a circuit diagram illustrating a connection state of a solenoid and a driver in accordance with one embodiment of the present invention.

FIG. 5 is a diagram illustrating a time-current relationship of a solenoid in a state where impressed voltage is made uniform in accordance with one embodiment of the present invention.

FIG. 6 is a timing chart of a drive signal for driving solenoid output from a solenoid controller in accordance with one embodiment of the present invention.

FIG. 7 is a flowchart illustrating a method for stamping an item in accordance with one embodiment of the present invention.

DETAILED DESCRIPTION OF THE PREFERRED EMBODIMENTS

Figure 1:
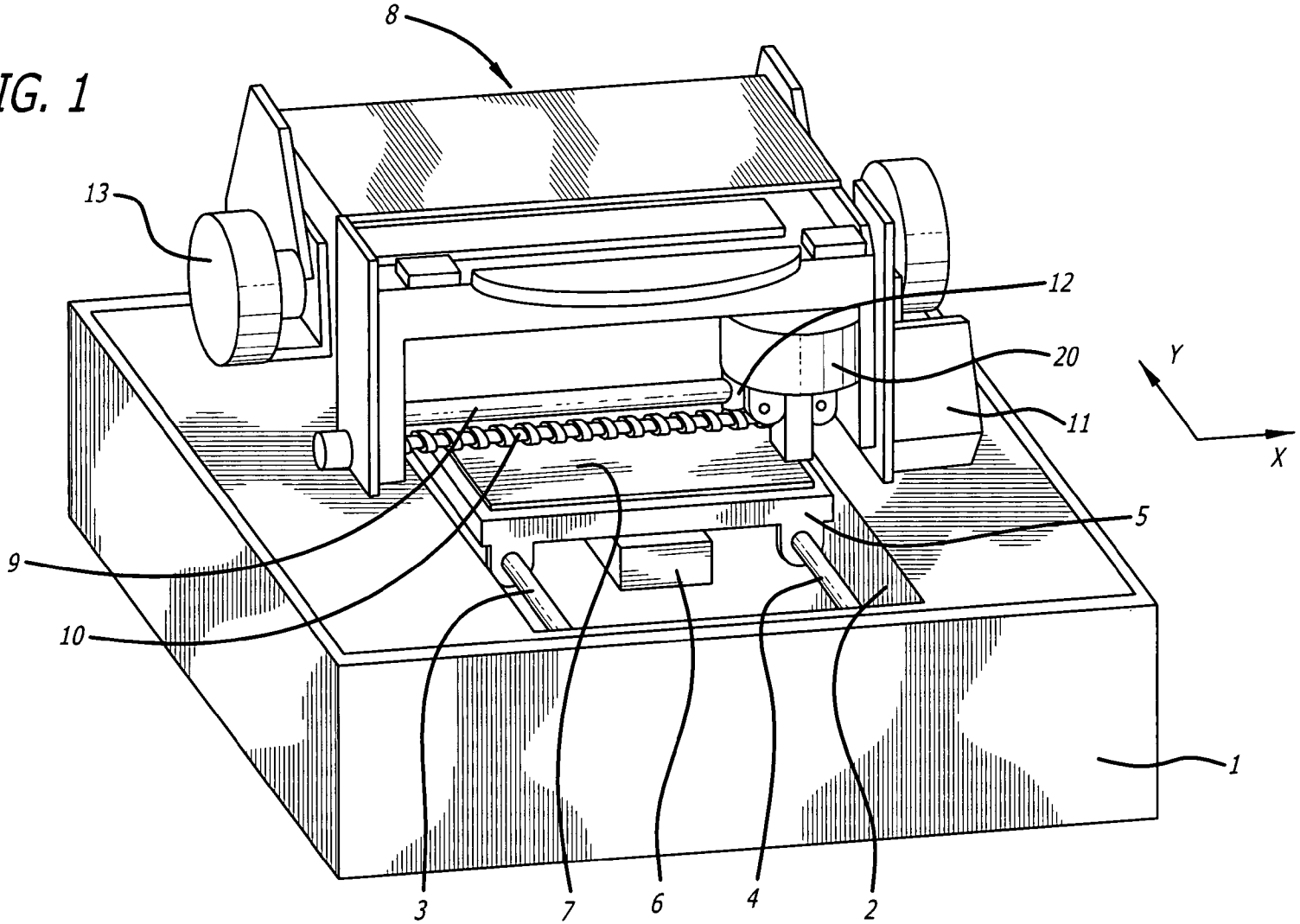
FIG. 1 is an exterior perspective view of a stamping machine in accordance with one embodiment of the present invention.

The present invention relates to pressing a working tool on a surface of an item and forming an image on the item at a high speed.

FIG. 1 is an exterior perspective view of a stamping machine in accordance with one embodiment of the present invention.

As shown in FIG. 1, the stamping machine comprises a case 1 preferably formed in a box-like shape having a space therein. An opening 2 is formed in a central part of the case 1. Guide shafts 3, 4 are formed in the interior of the case 1 at the opening 2. Preferably, the guide shafts 3, 4 extend in the Y-direction of FIG. 1 and are provided parallel to each other separated by a prescribed interval. A motor 6 for controlling movement in the Y-axis is provided in the interior of the case 1 at the opening 2 in order to move a pedestal 5 in the Y-direction along the guide shafts 3, 4.

When in use, an item to be worked (worked item) 7 is placed and held on the pedestal 5. The worked item 7 may be fixed to the pedestal 5 via various adhesives, such as rubber or double-sided tape, for example.

A stamping part 8 is provided on an upper part of the case 1. A guide shaft 9 and a head driver 10 extending in the X-direction in the stamping part 8 are also provided. A stamping head 20, i.e., the working tool of the stamping machine of the present invention, is movable along the guide shaft 9 and the head driver 10. The stamping head 20 is provided such that it faces the worked item 7 positioned on the upper part of the pedestal 5. As shown in FIG. 1, only one guide shaft 9 is illustrated. However, as shown in FIG. 2(C), a pair of guide shafts (9) are preferably provided, wherein the pair of guide shafts 9 are separated by a prescribed interval. Preferably, the head driver 10 comprises a drive shaft having a groove formed in a spiral shape and rotated by a motor 11 for controlling movement in the X-axis provided on the outside of the stamping part 8. However, in other aspects of the invention, the head driver 10 may be a flexible track or other driving mechanism capable of moving the stamping head 20. As shown in FIG. 2(A), a joining piece 27 connects with the groove of the head driver 10 to operatively couple the head driver 10 to the stamping head 20 via a slide member 12.

Moreover, the slide member 12 is formed on and slidable along the length of the guide shaft 9. The stamping head 20 is attached to the slide member 12 via an attachment tool 23, as shown in FIG. 2(A). Accordingly, by means of the head driver 10 being driven by the motor 11, the stamping head 20 moves in the X-direction along the guide shaft 9 when the head driver 10 moves the slide member 12. As a result, because the pedestal 5 may be moved in the Y-direction and the stamping head 20 may be moved in the X-direction, the stamping head 20 may be moved to face any desired position of the worked item 7.

Preferably, the stamping part 8 is formed such that a support shaft is operatively connected with the stamping part 8 and rotated by a rotating dial 13. By causing the rotating dial 13 to rotate the support shaft in the direction of the arrow in FIG. 1, a front side of the stamping part 8 opens for exposing the worked item 7. In this position, the worked item 7 on the pedestal 5 may be replaced.

FIG. 2 illustrates a stamping head 20 in accordance with one embodiment of the present invention, wherein (A) is the front view, (B) is a view seen from the B-direction of (A); (C) is a view seen from the C-direction of (A), (D) is a wire arrangement diagram of a head front end part seen from the D-direction of (C), (E) is a view seen from the E-direction of (D), (F) illustrates a head wire and (G) illustrates the tip of the head wire enlarged.

Preferably, the stamping head 20 incorporates a dot impact printer mechanism, specifically, a cylindrical shaped head frame 21, a front end part 22 extending from the head frame 21 in an approximately square cylinder shape and the attachment tool 23. Advantageously, the stamping head 20 may stamp at a speed of 1000 Hz. However, the stamping head 20 preferably stamps at a speed of 350 Hz to allow for safe operation of the stamping machine.

Normally, a tip of a printing wire of a dot impact printer is flat and cannot stamp on a metal surface if left unchanged. Therefore, this component of the dot impact printer must be modified for use with the stamping machine of the present invention. Furthermore, because a normal dot impact printer does not provide for the application of strength when driving the printing head, a dot impact printer is not suitable to perform the functions of the present invention without modifications.

In accordance with the preferred embodiment of the present invention, the stamping machine utilizes the drive mechanism of the printing part of a dot impact printer. Preferably, in place of the printing wire of the dot impact printer, a head wire 30 is formed with a hard metal having a diameter of approximately 0.3 mm, for example. As shown in FIG. 2(F), a button 31 comprising a resin, such as nylon, is formed at one end of the head wire 30. The button 31 supports a coil spring 45 with a wire guide 24, as shown in FIG. 2(C). At the other end of the head wire 30, a front end part 32 is formed in a spindle shape preferably having an angle of 90 degrees. Preferably, the front end part 32 has a conical shape, as shown in FIG. 2(G).

As stated above, the stamping head 20 comprises the cylindrical shaped head frame 21, the front end part 22 extending from the head frame 21 in an approximately square cylinder shape and the attachment tool 23. Preferably, the attachment tool 23 is screwed shut to the slide member 12. Accordingly, the stamping head 20 is movable along the X-direction with the slide member 12. Inside the front end part 22, the head wire 30 is housed. The head wire 30 may be a wire member of nine wires, for example.

As shown in FIG. 2(A), a pair of through holes 26 are formed in the slide member 12 through which the pair of guide shafts 9 pass through. In addition, the joining piece 27 is formed on the slide member 12 and joins with the groove of the head driver 10 so that the slide member 12 and the head driver 10 mate. When the head driver 10 is caused to drive and rotate, the joining piece 27 is mated with the groove of the head driver 10 causing the stamping head 20, which is attached to the slide member 12, to move in the X-direction (as shown in FIG. 1) along the guide shafts 9, wherein the guide shafts 9 run through the through holes 26.

At the front end of the stamping head 20, a flat surface is formed facing the worked item 7. Tips of nine head wires 30, for example, may protrude at the flat surface. Preferably, the tips of the nine head wires 30, as shown in FIG. 2(D), (E), are arranged in a staggered formation and straddling a central line so as to not have open spaces between the adjacent head wires 30.

Furthermore, a side of the head wire 30, where the button 31 is located, is guided by the wire guide 24 provided inside the head frame 21. Preferably, the button 31 of the head wire 30 is removably attached to an end of an arm 41 provided inside the head frame 21.

As stated above, nine wires are preferably provided for the head wire 30. If the nine wires are used simultaneously, the stamping time may be shortened. Moreover, if one wire among the nine wires is used sequentially, the life of the stamping head 20 may be lengthened. Also, if the head wires 30 are arranged in a matrix shape, processing time may be shortened.

Another end of the arm 41 contacts one end of a leaf spring 42. A central part of the arm 41 is fixed to the other end of a plunger 44 driven by a solenoid 43. The other end of the leaf spring 42 is fixed to a wall surface of the head frame 21. As stated above, the button 31 of the head wire 30 (preferably nine head wires) is attached to one end of the arm 41. The other end of the arm 41 is impelled to the wall surface side of the head frame 21 by the leaf spring 42.

In a normal state, a front end of the arm 41 forms a line with a front end surface of the stamping head 20. When the solenoid 43 is driven in response to data, the plunger 44 is attracted to the solenoid 43. Accordingly, the head wire 30 resists an elastic force of the coil spring 45 and protrudes from the front end surface of the stamping head 20. As such, a front end part 32 of the head wire 30 may form a conical shaped hole in the worked item 7 when the head wire 30 is stamped against the worked item 7. Notably, a size of the hole diameter in the worked item 7 may be changed if the stamping strength of the head wire 30 is changed. Thus, an image corresponding to the data may be created on the surface of the worked item 7. When the solenoid 43 is no longer driven, the head wire 30 returns to the original position via the elastic force of the coil spring 45.

Alternatively, a permanent magnet may be provided in a core of the stamping head 20 in place of the solenoid 43. Accordingly, the head wire 30 attached to the front end part of an armature is driven via the attraction with the core. Because a coil wrapped around the core drives, the front end part of the head wire 30 presses against the worked item 7.

FIG. 3 is a schematic block diagram of a control circuit for controlling a stamping machine in accordance with one embodiment of the present invention. FIG. 4 is a circuit diagram illustrating a connection state of a solenoid and a driver in accordance with one embodiment of the present invention.

As shown in FIG. 3, a host computer 50 is provided for controlling the stamping machine. The host computer 50 comprises a central processing unit (CPU) 51, a solenoid controller 52 and a driver 53. A display part 55 is connected to the host computer 50. A voltage impressing time-pressing force conversion table is stored in the CPU 51, wherein the conversion table demonstrates the relationship between a time for applying voltage and a pressing force of the solenoid 43 that drives the plunger 44.

The CPU 51 outputs a processing signal to the solenoid 43 via the solenoid controller 52 and the driver 53. The driver 53, as shown in FIG. 4, for example, comprises an NPN transistor 54. Preferably, a processing signal is provided to the base of the NPN transistor 54, the emitter of the NPN transistor is grounded, and the collector of the NPN transistor is connected to one end of a coil of the solenoid 43. Direct current voltage+V is supplied to the other end of the coil. When the processing signal is provided to the base, the NPN transistor 54 conducts and an electric current flows to the coil of the solenoid 43 connected to the collector.

FIG. 5 is a diagram illustrating a time-current relationship of a solenoid in a state where impressed voltage is made uniform in accordance with one embodiment of the present invention.

Referring to FIG. 5, the solenoid 43 is provided such that even if voltage is impressed, the electric current value only gradually increases. Utilizing this characteristic, by making the impressed voltage uniform and controlling the impressing time, the electric current value that flows to the coil of the solenoid 43 is controlled. That is, by means of the above-mentioned conversion table that demonstrates the relationship between the impressing time and the pressing force, it is possible to determine an impressing time value for a corresponding pressing force value.

Furthermore, because the electric current value may be controlled by varying the impressing time, if the voltage is made uniform and the impressing time is varied, the pressing force may also be controlled (electric power=voltage×electric current). Accordingly, by means of this control, controlling the pressing force in unlimited steps is possible.

FIG. 6 is a timing chart of a drive signal for driving solenoid output from a solenoid controller in accordance with one embodiment of the present invention. As shown in FIG. 6, the solenoid 43 driving force and pressing force are provided by one signal. That is, the pressing force of the head wire 30 becomes large in proportion to the impressing time T1, T2, etc. Thus, a conical hole of a desired size may be formed on the worked item 7 in proportion to the impressing time.

FIG. 7 is a flowchart illustrating a method for stamping an item in accordance with one embodiment of the present invention. As shown in FIG. 7, image density data are provided to the host computer 50 (step SP1). The CPU 51 of the host computer 50 then converts the image density data to a hardware control parameter (step SP2). Here, the hardware control parameter is the pressing force, which is equal to the solenoid attractive force, and is equivalent to the impressing time for impressing the voltage on the solenoid 43. The hardware control parameter is then outputted (step SP3) and the solenoid 43 is driven.

As a result of the present invention described above, stamping a worked item at high speed is achieved. Specifically, stamping at high speed is made possible by providing data to the stamping machine for the purpose of working the worked item 7. Moreover, based on the provided data, the impressing time is controlled and the solenoid 43 is controllably driven to control the strength of the pressing force of the head wire 30. Also, the working depth may be controlled when pressing the worked item 7 by the conical parts of the front end part 32 of the head wire 30.

The stamping machine of the present invention may be used to process items such as accessories, jewelry and the like.

The foregoing embodiments and advantages are merely exemplary and are not to be construed as limiting the present invention. The present teaching can be readily applied to other types of apparatuses. The description for the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. A stamping machine for pressing a working tool against a surface of a worked item, the stamping machine comprising:

at least one guide shaft extending in a first direction;

a pedestal movable along the at least one guide shaft in the first direction for holding the worked item; and a stamping part for pressing the working tool against the worked item held on the pedestal, wherein the stamping part comprises:

at least one guide shaft extending in a second direction;

a head driver extending in the second direction;

a stamping head movable along the at least one guide shaft and the head driver in the second direction, wherein the stamping head is proximal to the pedestal for holding the worked item; and a rotating dial for rotating the stamping part.

2. The stamping machine of claim 1, wherein the at least one guide shaft extending in the first direction is a pair of guide shafts formed parallel to each other and separated by a prescribed distance.

3. The stamping machine of claim 1, wherein the worked item is fixed to the pedestal by an adhesive.

4. The stamping machine of claim 1, wherein the at least one guide shaft extending in the second direction is a pair of guide shafts formed parallel to each other and separated by a prescribed distance.

5. The stamping machine of claim 1, further comprising a first motor for moving the pedestal along the at least one guide shaft in the first direction.

6. The stamping machine of claim 1 further comprising a second motor for moving the stamping head along the at least one guide shaft in the second direction.

7. The stamping machine of claim 6, wherein the head driver comprises a groove formed in a spiral shape and is rotated by the second motor.

8. The stamping machine of claim 7, further comprising a joining piece connecting with the groove of the head driver for operatively coupling the head driver to the stamping head via a slide member, wherein the slide member is formed on and slidable along the at least one guide shaft in the second direction.

9. The stamping machine of claim 8, wherein the stamping head is attached to the slide member by an attachment tool.

10. The stamping machine of claim 1, further comprising a computer for controlling the stamping machine.

11. The stamping machine of claim 1, further comprising a case, wherein the at least one guide shaft is supported by the case.

12. A stamping machine for pressing a working tool against a surface of a worked item, the stamping machine comprising:

at least one guide shaft extending in a first direction;

a pedestal movable along the at least one guide shaft in the first direction for holding the worked item; and a stamping part for pressing the working tool against the worked item held on the pedestal, wherein the stamping part comprises:

at least one guide shaft extending in a second direction;

a head driver extending in the second direction; and a stamping head movable along the at least one guide shaft and the head driver in the second direction, wherein the stamping head is proximal to the pedestal for holding the worked item and stamps at a maximum speed of 1000 Hz.

13. A stamping machine for pressing a working tool against a surface of a worked item, the stamping machine comprising:

at least one guide shaft extending in a first direction;

a pedestal movable along the at least one guide shaft in the first direction for holding the worked item; and a stamping part for pressing the working tool against the worked item held on the pedestal, wherein the stamping part comprises:

at least one guide shaft extending in a second direction;

a head driver extending in the second direction; and a stamping head movable along the at least one guide shaft and the head driver in the second direction, wherein the stamping head is proximal to the pedestal for holding the worked item, and wherein the stamping head comprises:

a cylindrical-shaped head frame;

a front end housing extending from the head frame; and an attachment tool for attaching the stamping head to the slide member.

14. The stamping machine of claim 13, further comprising a head wire housed within the front end housing and the cylindrical-shaped head frame for stamping the worked item, wherein an outer end of the head wire has a conical shape.

15. The stamping machine of claim 14, wherein the conical shape has an angle of 90 degrees.

16. The stamping machine of claim 14, wherein the head wire is a wire member comprising a plurality of wires.

17. The stamping machine of claim 15, wherein the plurality of wires protrude out of the front end housing toward the pedestal for stamping the worked item.

18. The stamping machine of claim 16, wherein the plurality of wires are arranged in a staggered formation and straddling a central line.

19. The stamping machine of claim 16, wherein the plurality of wires are used simultaneously.

20. The stamping machine of claim 16, wherein the plurality of wires are used sequentially.

21. The stamping machine of claim 14, wherein the head wire is controllably driven by a driving means housed within the stamping head.

22. The stamping machine of claim 21, wherein the driving means controllably drives the head wire in response to data.

23. The stamping machine of claim 21, wherein the driving means is at least one of:

a solenoid; and a permanent magnet.

24. The stamping machine of claim 14, wherein a stamping strength of the head wire is controllable.

* * * * *